United States Patent [19]

Stokes

[11] 4,430,555

[45] Feb. 7, 1984

[54] ELECTRODE STEAM BOILER AND METHOD OF OPERATION THEREOF

[75] Inventor: Ian D. Stokes, Krugersdorp-North, South Africa

[73] Assignee: Marshall-Fowler Limited, South Africa

[21] Appl. No.: 187,061

[22] Filed: Sep. 15, 1980

[30] Foreign Application Priority Data

Sep. 17, 1979 [ZA] South Africa ..... 79/4905
Mar. 25, 1980 [ZA] South Africa ..... 80/1733

[51] Int. Cl.[3] ..... F22B 1/30; H05B 1/02; H05B 3/60

[52] U.S. Cl. ..... 219/286; 122/4 A; 219/273; 219/295; 338/86

[58] Field of Search ..... 219/284–295, 219/271–276; 122/4 A; 338/80–86

[56] References Cited

U.S. PATENT DOCUMENTS 1,650,632 11/1927 Kowallik ..... 219/286
1,738,733 12/1929 Schur et al. ..... 219/284
4,196,341 4/1980 Williams ..... 219/295

FOREIGN PATENT DOCUMENTS 413342 5/1925 Fed. Rep. of Germany ..... 219/284
111608 8/1944 Sweden ..... 219/288

*Primary Examiner*—A. Bartis
*Attorney, Agent, or Firm*—McGlew and Tuttle

[57] ABSTRACT

An electrode boiler includes a boiler shell having at least two spaced electrodes arranged about a vertical axis and positioned to be at least partially immersed in a water zone in the shell; the water zone including a relatively cold water zone below the lower edges of the electrodes. A pair of vertically spaced nozzles are provided for introducing water into the shell during operation of the boiler. The vertically higher nozzle is arranged to introduce water into the shell in the water zone directly between the electrodes in substantially horizontal radially-directed jets. The vertically lower nozzle is arranged to introduce water directly into the relatively cold water zone in a stream directed on the base of the boiler shell. Boiler pressure responsive control of a feed water supply system allows water to be supplied to the boiler only through the vertically upper nozzle when the boiler is at or below a normal pre-set boiler steam pressure, and only through the vertically lower nozzle when the pre-set boiler steam pressure is exceeded, thereby minimizing electrical load and water level fluctuations that would occur or be aggravated by introduction of relatively cold water into the water zone between the electrodes while the boiler is overpressure. At fixed time intervals while the boiler is at or below the pre-set pressure, the introduction of water through the upper nozzle is terminated and highly conductive salt laden water is bled therethrough from between the electrodes to waste.

12 Claims, 1 Drawing Figure

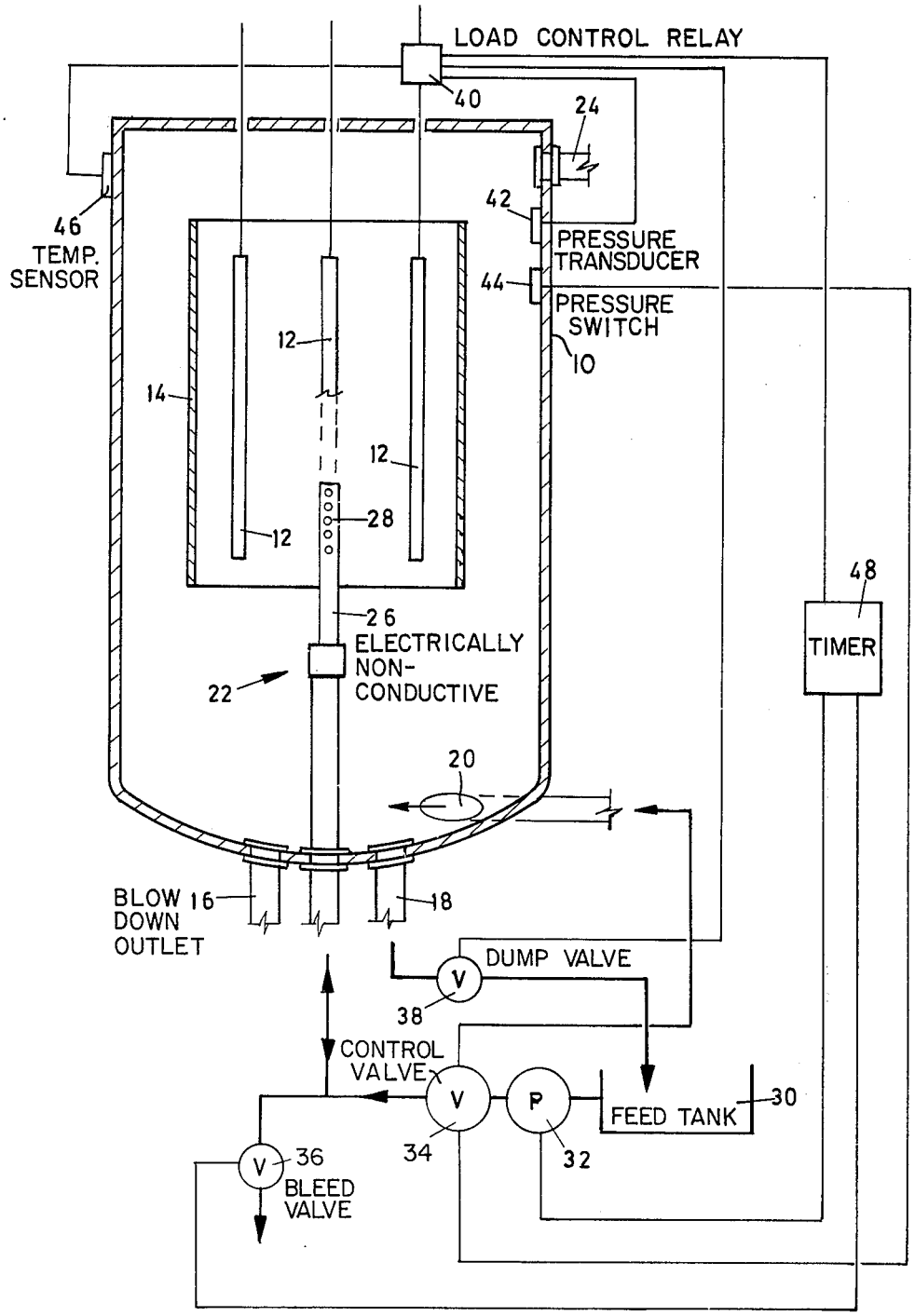
LOAD CONTROL RELAY
40
24
42
PRESSURE TRANSDUCER
44
PRESSURE SWITCH
10
46
TEMP. SENSOR
12
14
12
12
28
26
ELECTRICALLY NON-CONDUCTIVE
22
20
48
TIMER
BLOW DOWN OUTLET
16
18
DUMP VALVE
V
38
CONTROL VALVE
V
P
FEED TANK
30
34
32
V
36
BLEED VALVE

ELECTRODE STEAM BOILER AND METHOD OF OPERATION THEREOF

FIELD OF THE INVENTION

This invention relates to electrode boilers for generating steam and to a method of operating the boilers.

SUMMARY OF THE INVENTION

A method of operating an electrode boiler according to the invention includes the steps of introducing water into the boiler while the boiler is below or substantially at a pre-set steam pressure, directly into the electrode zone of the boiler and into a relatively cold water zone below the electrode zone, when the steam pressure in the boiler is above the pre-set pressure.

Preferably while the boiler is below or substantially at the pre-set steam pressure, water is introduced into the boiler at a point above the lower edges of the electrodes.

In one form of the invention the boiler electrodes are arranged about a vertical axis and the water is introduced into the boiler in substantially horizontal radially directed jets from a position on the axis about which the electrodes are arranged.

Conveniently, while the steam pressure in the boiler is above the pre-set pressure, water is introduced into the boiler so that a stream of inlet water impinges on the base of the boiler.

An electrode boiler according to the invention includes a boiler shell, at least two electrodes in the shell, means for introducing water into the shell at two vertically spaced positions with the uppermost water introduction means being located to introduce water into the boiler zone between the electrodes. Preferably the boiler includes a steam pressure switch in the shell which is adapted to switch water introduction from the uppermost water introducing means to the vertically lower water introduction means when the steam pressure in the boiler rises above a pre-set level.

The uppermost water introducing means may consist of a tube which passes through the shell with its free end including a water outlet nozzle which is directed into the space in the shell between the electrodes. Conveniently the water introducing tube includes a connector in which is located a releasible tubular nozzle member which has a closed end and a plurality of radially directed apertures which are located in the boiler shell above the lower edges of the electrodes. The steam pressure switch may be vertically spaced from the closed free end of the tube.

Further according to the invention the vertically lower water introduction means is a water nozzle which passes through the wall of the shell and is positioned to direct a stream of water on to the base of the shell.

BRIEF DESCRIPTION OF THE DRAWING

An embodiment of the invention is now described by way of example with reference to the drawing which is a schematic sectioned side elevation of the boiler and its external hydraulic and electrical circuits.

DETAILED DESCRIPTION OF THE PREFERRED EMBODIMENT

The boiler of the invention is shown in the drawing to comprise a shell 10, three electrodes 12 which are connected through a suitable switching arrangement (not shown) to a three-phase electrical supply, a neutral shield 14, a conventional blow down outlet 16, a water dump outlet 18, a water inlet 20, a water inlet and outlet tube which is indicated generally at 22, and a steam outlet 24.

The arrangement of the electrodes 12 and shield 14 are conventional and although not illustrated in the drawing the electrodes are spirally interleaved substantially to encircle the free end of the tube 22.

The boiler shell 10 has an outwardly domed base with the inlet 20 arranged in the wall of the shell to introduce water into the boiler tangentially on to its base.

The water inlet and outlet tube 22 includes a coupling arrangement in which a tube 26 is releasibly engaged. The tube 26 is made from heat resistant plastics or ceramic material to minimise the possibility of damage to the tube by electrolytic erosion. The tube carries, from a position which is substantially in register with the lower ends of the electrodes 12 to its free end, which is closed, a plurality of vertically spaced radially directed apertures 28 through which water may enter and leave the boiler.

The external hydraulic circuit of the boiler is shown to comprise a feed tank 30, a pump 32, a control valve 34, a bleed valve 36, a dump valve 38 and hydraulic lines connected between the various components of the hydraulic circuit and the boiler as shown in the drawing.

The electrical, pressure and temperature control of the boiler is largely conventional and is provided by an electrical load control relay 40, a pressure transducer 42 which modulates or controls the boiler electrical load through the relay 40 in dependence on the steam pressure in the boiler, a pressure switch 44 for switching water from the pump 32 to either the tube 22 or the inlet 20 in dependence on steam pressure, a temperature sensor 46 for changing the electrical load in dependence on shell temperature and a timer 48 in a line between the electrical load control relay 40 and pump 32.

In use, and while the boiler is below its set operating steam pressure, water is pumped by pump 32 from the tank 30 through the valve 34 and tube 22 and its apertures 28 into the boiler. The operation of the boiler in terms of temperature and steam pressure control of the electrical load, is conventional at steam pressures up to the pre-set pressure.

As is well known in the electrode boiler art, salt concentrations are built up during boiler operation in the hot water zone between the electrodes seriously to affect the electrical conductivity of the water in the electrode zone and so cause difficult-to-control electrical load fluctuations. Additionally the increased conductivity of the water in the electrode zone causes high inter-electrode current densities which, by electrical erosion, shorten the useful life of not only the electrodes but also of the shield 14 and the boiler shell 10.

The reason for introducing fresh water into the boiler of the invention through the tube 22 during or below normal operating conditions is that the water leaving the apertures 28 in the tube 22 causes the accumulated salts between the electrodes to be agitated and mixed to minimize the possibility of the development of highly conductive arc paths between the electrodes.

The load and pressure drop that will be occasioned by the introduction of relatively cold water into the hot water zone between the electrodes during normal conditions of pressure in the boiler will not adversely affect the operation of the boiler.

Water is bled from the boiler at fixed time intervals which are determined by the timer 48 which during the bleed periods of boiler operation stops the operation of the pump 32 (which otherwise operates to introduce water into the boiler on demand from the loadcontrol relay to be consumed as steam), and opens the valve 36 to bleed the hightly conductive salt laden water from between the electrodes to waste. This periodic removal of the conductive water from the electrode zone of the boiler minimizes the conductivity and so the erosion problems mentioned above. The erosion problem will, however, although lessened not be completely eliminated and the purpose of the vertical spacing of the apertures 28 in the tube 26 is to ensure that even though the lower ends of the electrodes 12 are eroded in time that water is always introduced into the electrode zone to minimize the formation of arc paths between the electrodes and shield 14.

When the boiler goes overpressure, water is dumped in fairly large quantities from the relatively cold water portion of the boiler through the outlet 18 and dump valve 38 to the tank 30 to reduce pressure.

Under overpressure conditions, the valve 34 is switched so that relatively cold water from the tank 30 is introduced into the boiler through the inlet 20 in the base of the boiler in place of through the tube 22 to minimize the large electrical load and water level fluctuations that would otherwise occur or be aggravated by introducing the relatively cold water into the boiler in the electrode zone while the boiler is overpressure. When the steam pressure in the boiler again returns to normal or goes below normal during operation, the valve 34 is again switched by the pressure switch 44 to the line to the tube 22.

The purpose of the tangental arrangement of the water inlet 20 is to cause lime scale ($CaCO_3$) which has accumulated on the base of the boiler to be driven into suspension in the boiler water to be evacuated from the boiler during water dumping to minimize scale build up on the boiler base. A suitable filter (not shown) in the tank 30 prevents the lime scale from being re-introduced into the boiler.

The invention is not limited to the precise constructional details or method of operation as herein described and the valves and hydraulic lines of the boiler hydraulic circuit and the electrical and pressure control arrangements could be modified and re-arranged in any convenient fashion provided that while the boiler is at or below normal operation pressure water from the tank 30 is introduced into the boiler in the hot water zone adjacent the electrodes 12 and during overpressure conditions into a xone of relatively colder water below the hot water electrode zone. For example, the multipath control valve 34 could be replaced by a single direction on/off valve in a direct line from the tank 30. The line to the tube 22 on the upstream side of the take off point for the line to the inlet 20 and on the downstream side of the take off point for the bleed valve 38 could in this event include a flow restriction orifice through which water is continually fed to the tube 22 during water introduction cycles of boiler operation.

I claim:

1. A method of operating an electrode boiler having a boiler shell and spaced electrodes disposed in an electrode zone located above a relatively cold water zone in the boiler shell including the steps of energizing the electrodes, continuously sensing steam pressure in the boiler, establishing a pre-set boiler steam pressure, introducing water into the boiler while the boiler is below or substantially at the pre-set steam pressure, directly into the electrode zone of the boiler, and, when the steam pressure in the boiler is above the pre-set pressure, introducing the water only into the relatively cold water zone below the electrode zone.

2. A method as claimed in claim 1, wherein the electrodes have lower edges and in which, while the boiler is below or substantially at the pre-set steam pressure, the water is introduced into the electrode zone at a point above the lower edges of the electrodes.

3. A method as claimed in claim 1 in which, while the steam pressure in the boiler is above the pre-set pressure, the water is introduced into the boiler so that a stream of inlet water impinges on the base of the boiler.

4. A method as claimed in claim 1, in which the boiler electrodes are arranged about a vertical axis and while the boiler is below or substantially at the pre-set pressure the water is introduced into the electrode zone in substantially horizontal radially directed jets from a position on the axis about which the electrodes are arranged and above the lower edges of the electrodes.

5. A method as claimed in claim 1 further comprising the step of bleeding water from the boiler at predetermined time intervals.

6. An electrode boiler including a boiler shell having a water zone, at least two spaced electrodes positioned to be at least partially immersed in the water zone in the shell, the water zone including a relatively cold water zone below the electrodes two vertically spaced nozzles for introducing water into the shell with each nozzle being adapted for connection to a separate water feed line to the shell with a first vertically higher one of the nozzles being directed to introduce water into the shell in the water zone directly between the electrodes and the second vertically lower one of the nozzles being directed to introduce water directly into the relatively cold water zone below the electrodes in the shell, means including a steam pressure switch in the shell responsive to sensing a pre-set steam level in the boiler for switching water introduction from the first nozzle to the second nozzle when the steam pressure in the boiler rises above a pre-set level and a water outlet from the shell.

7. An electrode boiler as claimed in claim 6, in which the electrodes have lower edges and the water feed line to the first nozzle is a tube which enters the shell and to which the first nozzle is releasably attached with the first nozzle comprising a tubular nozzle member which has a closed end which is remote from its end which is connected to the tube and a plurality of radially directed apertures which are located in the boiler shell above the lower edges of the electrodes.

8. An electrode boiler as claimed in claim 7, in which the radially directed apertures in the tubular nozzle member extend vertically over a portion of a length of the tubular nozzle member from its closed end.

9. An electrode boiler as claimed in claim 8, in which the tubular nozzle member is made from an electrically non-conductive material.

10. An electrode boiler as claimed in claim 6, in which the second nozzle is positioned in the shell to direct a stream of inlet water on a base of the shell.

11. An electrode boiler as claimed in claim 10, in which the base of the shell is outwardly domed and the second nozzle is positioned to direct a stream of inlet water tangentially on to the domed base.

12. An electrode boiler as claimed in claim 6, including a timer arrangement adapted to operate a valve for bleeding water from the shell through the first nozzle at timed intervals between periods of water introduction through the first nozzle and to periodically terminates the introduction of water through the first nozzle while the boiler pressure is below or at the pre-set pressure.

* * * * *

UNITED STATES PATENT AND TRADEMARK OFFICE

CERTIFICATE OF CORRECTION

PATENT NO. : 4,430,555

DATED : February 7, 1984

INVENTOR(S) : IAN DAVID STOKES

It is certified that error appears in the above-identified patent and that said Letters Patent is hereby corrected as shown below:

On the title page the assignee should read as follows:

-- MARSHALL-FOWLER (SOUTH AFRICA)(PROPRIETARY) LIMITED --.

Signed and Sealed this

*Twelfth* Day of *June 1984*

[SEAL]

*Attest:*

GERALD J. MOSSINGHOFF

*Attesting Officer*

*Commissioner of Patents and Trademarks*